US005421480A

United States Patent [19]

Cudzik

[11] Patent Number: 5,421,480

[45] Date of Patent: Jun. 6, 1995

[54] THIN-WALLED CAN HAVING A DISPLACEABLE BOTTOM

[75] Inventor: Daniel F. Cudzik, Chesterfield County, Va.

[73] Assignee: Reynolds Metals Company, Richmond, Va.

[21] Appl. No.: 45,545

[22] Filed: Apr. 8, 1993

[51] Int. Cl.[6] ..... B65D 8/04

[52] U.S. Cl. ..... 220/624

[58] Field of Search ..... 220/624

[56] References Cited

U.S. PATENT DOCUMENTS 3,610,018 10/1971 Swanson et al. .
3,979,009 9/1976 Walker .
3,998,174 12/1976 Saunders .
4,037,752 7/1977 Dulmaine et al. .
4,134,354 1/1979 Cvacho et al. .
4,157,693 6/1979 Openchowski et al. .
4,177,746 12/1979 Lee, Jr. et al. .
4,222,494 9/1980 Lee, Jr. et al. .
4,402,419 9/1983 MacPherson .
4,412,627 11/1983 Houghton et al. .
4,426,013 1/1984 Cherchian et al. .
4,732,292 3/1988 Supik .

*Primary Examiner*—Joseph Man-Fu Moy

*Attorney, Agent, or Firm*—Robert C. Lyne, Jr.

[57] ABSTRACT

A thin-walled metal container is formed with a bottom wall having a substantially flat central panel connected to a curved wall portion through an annular, inclined flat or frustum wall portion. The curved wall portion joins the container side wall and is defined by the base radius. The inclined or frustum connecting wall portion acts as a hinge which enables the central panel to move between an upper, non-tensioned position and a lower, tensioned position. In the upper position, the annular downward facing surface of the curved wall located at the radially outermost periphery of the bottom wall defines a support surface which supports the container against necking, seaming, and filling column loads. After displacement of the central panel to the lower, tensioned position, which may occur after filling as a result of carbonation pressure, the container rests on a series of circumferentially spaced feet. These feet are also radially spaced to permit stacking engagement with the upper seamed end of another container. Since the bottom wall does not rely on inwardly curved mechanical features to resist internal pressurization, a thinner gauge metal can be used to satisfy design parameters and can achieve cost and metal reduction savings.

16 Claims, 2 Drawing Sheets

THIN-WALLED CAN HAVING A DISPLACEABLE BOTTOM

TECHNICAL FIELD

The present invention relates to thin-walled metal cans having a cylindrical sidewall and a bottom integral therewith, and, more particularly, to such can bottoms.

BACKGROUND ART

Today's market for metal beverage cans is extremely price competitive, which necessitates making the cans from the least amount of metal possible while still providing the necessary structural integrity. By using state of the art manufacturing techniques it is now possible to manufacture a 12 ounce aluminum can having a thin side wall, e.g., about 0.0040–0.0045 inch thick, with the side wall increasing in thickness at its upper end to about 0.0070–0.0075 inch to permit the forming of a can neck without collapsing or wrinkling the side wall. New necking processes are expected to yield metal and cost reduction in the neck region of the can. An example of such a process is the spin flow process disclosed in U.S. patent application Ser. No. 07/929,932, filed Aug. 14, 1992 and issued to the present assignee, Reynolds Metals Company. U.S. Pat. No. 4,781,047 issued to Ball Corporation also pertains to a spin flow process.

Notwithstanding the technological advances which have resulted in metal savings in the neck region of the can, the can bottom continues to be manufactured with a thickness of about 0.012 inch, which means that about one-third of the weight of the metal in the can must be in the bottom, to provide the necessary structural integrity. The can bottom must be able to sustain a column load of approximately 250 pounds during a spin flow necking process and 300 pounds during a die necking process. Later, it must sustain a column load of about 135 pounds when a can end is double-seamed on the can body after it has been filled with product. Another design criterion is a drop test for shock loads, in which the filled and seamed can must be able to resist a drop of about five inches without bottom reversal or increase in can height. In addition, a can filled with a carbonated beverage must be able to contain an internal pressure of about 40–100 psi.

To meet these requirements, conventional industry practice is to form the relatively thick bottom to have a profile with a concave or hollow central region. The bottom is formed into its final, inwardly domed shape between a hollow die engaging the internal surface of the bottom from the interior of the can and a punch engaging the external surface of the bottom. Cooperation of the punch and die creates a bottom having an inner wall at the outside of the concave region, an outer wall, and a rest radius connecting these two walls.

The resistance of the inwardly domed portion to outward bulging under internal pressure is greatly influenced by the size of the rest radius. The smaller the rest radius, generally the higher the internal pressure resistance of the can. Too large a radius will reduce this pressure to an unacceptable level. However, this conventional forming process works best if the rest radius is large, because during the process the sheet metal is pulled radially inward into the hollow region and, as viewed in profile, snakes around the radius on the punch and die. Too small a radius will create a fracture or thickness reduction. Thus, these two competing factors require compromise. Although advances are presently being made by the present assignee and others to reduce the rest radius of can bottoms to increase their bulge strength and thereby reduce their thickness, this approach inherently requires that the overall strength of the can bottom is dictated by mechanical features in the bottom.

U.S. Pat. No. 5,105,973, which issued Apr. 21, 1992 to Ball Corporation, contains a comprehensive discussion of inwardly domed can bottoms and the phenomena of dome reversal and roll-out (i.e., unrolling of inward profiles) caused by internal pressure, increases in overall can height resulting from this type of failure, and ways to strengthen inwardly domed can bottoms without unacceptably decreasing the internal volume of the can. See also U.S. Pat. Nos. 4,722,215 and 4,885,924 issued to Metal Box p.l.c., which concern reforming inwardly domed can bottoms in an additional operation, and U.S. Pat. Nos. 4,177,746 and 4,222,494 issued to Reynolds Metals Company, the assignee hereof. Inwardly domed can bottoms will not be discussed further herein, since the present invention does not employ an inwardly domed can bottom and is intended to be an alternative to that approach.

It is an object of the present invention to reduce the thickness of the metal in a can bottom without affecting the structural integrity of the can.

Another object is to reduce the metal in the can bottom to a thickness of approximately 0.0070 inch to thereby reduce its weight by approximately 30% while still enabling the can to satisfy design requirements.

Yet a further object of the invention is to provide a can bottom formed without inwardly curved mechanical features.

A further object is to provide a can bottom wherein the tensile strength of the metal provides sufficient strength to satisfy the design requirements.

Summary of the Invention

For clarity and consistency, some of the terms used in the specification and the claims hereof will now be defined. "Can" and "container" are used interchangeably. "Can end" or "lid" means a closure which is, or is intended to be, affixed to a can body containing a product. When the product is a beverage, the can end and can body are typically sealed together at a circular double-seam. Directional terms such as "upper", "lower", "side", "horizontal", and "vertical" refer to cans, can bodies, and can ends as though they are resting upright on a horizontal table. It will be understood, however, that the can bodies may be, and probably will be, in different orientations as they are being manufactured. "Axis" and "axial" refer to the longitudinal axis of the can body, and "radial" and "radially" relate to that axis. "Profile" means the profile of a can end or can body as viewed in a cross-section taken along its longitudinal (vertical) axis. "Radius" refers to a curve in the profile of the can body. The "rest surface" of a can body is the line or area at its very bottom which contacts a horizontal surface when the can body is resting upright on the surface.

A metal container according to the present invention comprises a bottom wall and a cylindrical side wall extending from the bottom wall to define an open end which is adapted to be closed with a can end. The bottom wall includes a pre-formed central panel, an outer curved wall portion extending from the side wall toward the central panel, and a substantially flat wall portion extending generally continuously between the curved wall portion and the central panel. The central panel is movable between an upper position, in which the outer curved wall portion is adapted to support the container during filling, and a lower position, which may occur as a result of internal pressurization. In this lower position, the central panel is in tension and advantageously cooperates with the curved and flat connecting wall portions to resist outward bulging of the bottom as a result of such pressurization.

Therefore, in a preferred embodiment of the present invention, the bottom wall is formed without inwardly curved, mechanical features which would be susceptible to unrolling by metal reversal as a result of carbonation pressure within the filled and sealed container. The central panel is preferably flat. The unique bottom wall construction of this invention is believed to make it possible to utilize a thinner gauge metal, such as 0.007 inch thick as opposed to a conventionally used metal 0.012 inch thick, to achieve corresponding metal and cost reduction savings.

The flat wall portion is an inclined or frustum annular wall portion which is movable, relative to the curved wall portion, to act as a hinge enabling the central panel to move into its upper or lower position. In the upper, non-tensioned position of the central panel, the inclined wall projects upward in the radially inward direction and, in the lower, tensioned position of the panel, the inclined wall projects downward in the radially inward direction.

The annular curved wall defines the rest radius. This curved wall has an annular downwardly facing surface which, in the upper, non-tensioned position of the central panel, constitutes the lowermost bottom support surface for supporting the container under necking, filling, and seaming column loads. By locating this support surface in the outer periphery of the bottom wall, i.e., immediately adjacent the container side wall, column loads are distributed along this region in a uniform and optimal manner.

A plurality of stacking projections or feet are preferably formed in the can bottom wall, radially inwardly from the curved wall portion. These feet present bottom rest surfaces which, in the lower, tensioned position of the central panel, define stable resting points on which the container may be positioned and supported on a flat, horizontal surface. In the upper, non-tensioned position of the central panel, these rest surfaces are displaced upwardly from their lowered position so that the curved wall portion supports the container and column loads acting thereon as described above.

The stacking feet are preferably formed in the inclined or frustum wall portion at circumferentially spaced locations, for example four feet spaced at 90° from each other or eight feet spaced 45° from each other. These feet are of sufficiently small surface area so as not to present any inwardly curved mechanical features which are capable of unrolling or deforming due to carbonation pressure after the central panel has been moved to its lower, tensioned position. Similarly, the areas of the inclined wall portion extending between the stacking feet are substantially flat and do not present profiled or curved features which are capable of unrolling to unnaturally deform the can under the action of normal carbonation pressure.

The central panel, inclined wall portion, and curved wall portion have substantially the same thickness which, in the preferred embodiment, is about 0.006–0.008 inch.

In accordance with other features of this invention, the radially outermost bottom surface of each stacking foot intersects the bottom surface of the surrounding inclined wall portion to define a substantially concave region, which is radially located in relation to the container axis to establish a stacking surface adapted to interfit with an upper seamed edge of an adjacent container below it to provide for stacking engagement.

More specifically, each stacking foot is preferably formed of first, second and third triangular faces which project downwardly from the inclined wall portion to meet at an apex. The first and second triangular faces are substantially identical, extend in a generally radial direction, and are larger than the third triangular face, which extends in a generally circumferential direction and has an upper edge base which is co-extensive with the outer periphery of the central panel. This third triangular face thus extends at a relatively steep slope in relation to the first and second triangular faces. The apex preferably is co-extensive with the base plane defined by the bottom surface of the curved wall in the upper, non-tensioned position of the central panel, to provide for maximum stacking height when the central panel is displaced into the lower position.

In accordance with a further feature of the present invention, the central panel and stacking feet are preferably formed in the bottom wall by utilizing existing drawing and ironing equipment containing minor modifications to the base reform tooling. The can is first drawn to essentially a cylindrical shape. On impact with base reform tooling, the bottom is reversed upwardly inward and the frustum or inclined wall is formed in the bottom wall together with the stacking projections. Thus, these features are advantageously added to the bottom wall during the reform action to prevent the can from being torn apart, which would be likely to occur if the features were added onto the punch or on the cup when the punch passes through the drawing and ironing rings, and the foregoing features are formed in the bottom wall at the bottom of the stroke after the can has been completely drawn and ironed.

Furthermore, since the steeply sloped, third triangular face of each stacking foot is elongated in the circumferential direction, the die stamping action of this steeply sloped face is distributed over a large circumferential area during the forming process which advantageously minimizes the possibility of metal tearing in the bottom wall.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
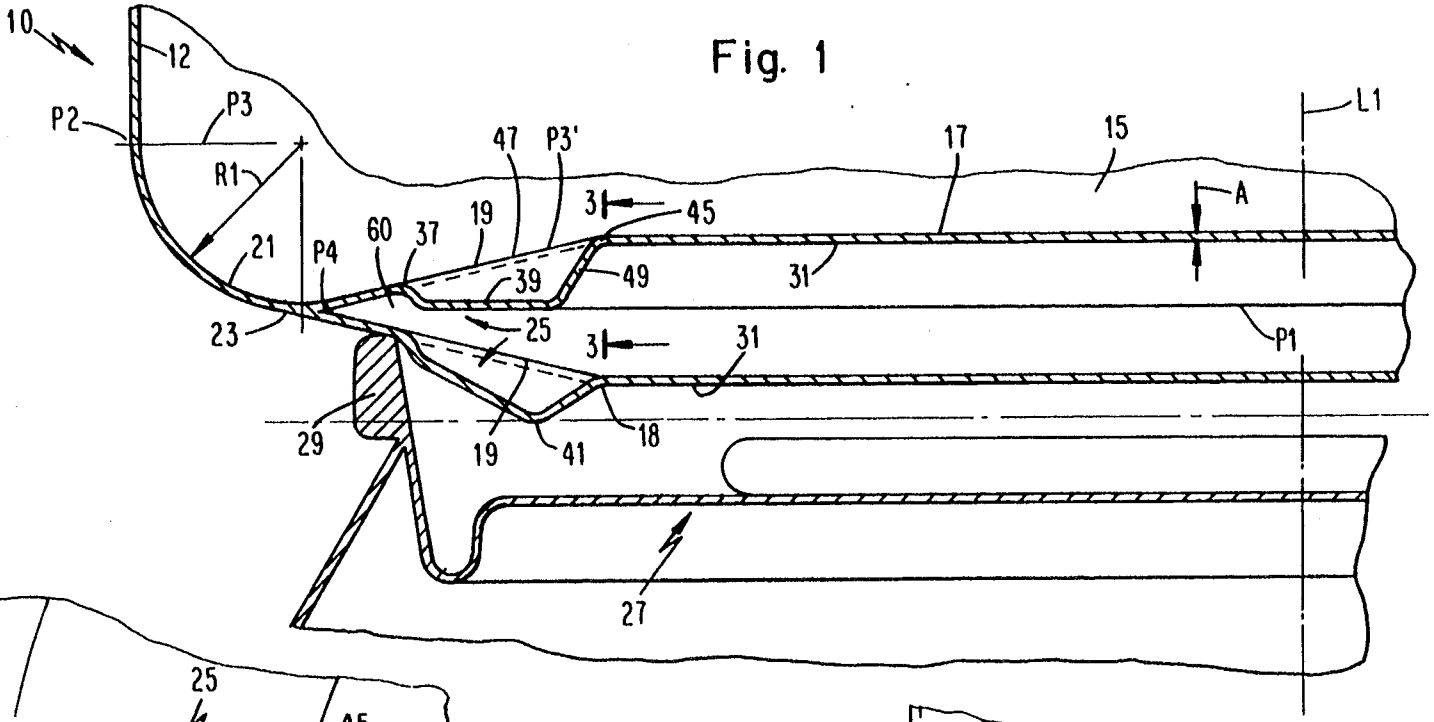
FIG. 1 is a detailed, cross-sectional view depicting important features of a metal container bottom wall in accordance with the present invention in stacked relationship with a like container.
Figure 3:
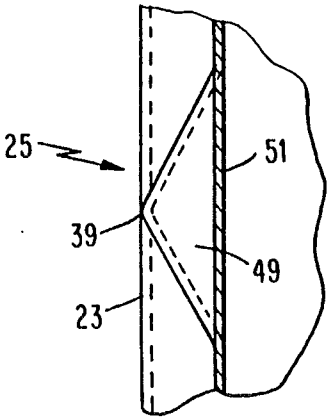
FIG. 3 is a sectional view taken along the line 3—3 of FIG. 1.
Figure 2:
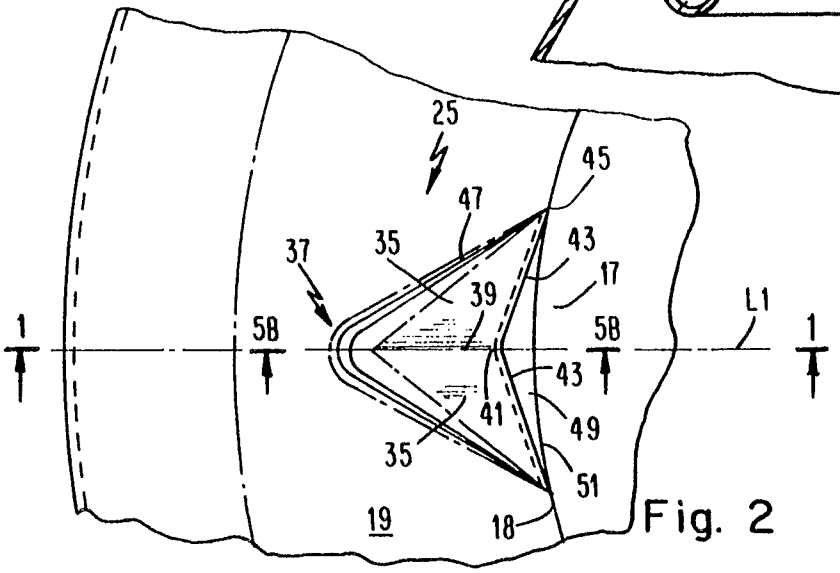
FIG. 2 is a top plan view of a stacking projection in the bottom wall of the present invention.

FIG. 1 is an illustration of a cylindrical, one-piece beverage container body 10 according to the present invention, which has a bottom integral with its side walls and is made of a relatively thin sheet material such as aluminum or steel. In the presently preferred embodiment of the invention, container 10 may be a 12 ounce beverage container made from one piece of sheet aluminum having an initial thickness of 0.012 inch. However, it is contemplated that the inventive concepts may be employed in containers made from various materials and with various other dimensions. The sheet is conventionally formed using drawing and ironing equipment, as is well known to one of ordinary skill in the can manufacturing art. This will result in a cylindrical container side wall 12 having a thickness in the range of 0.0040 to 0.0045 inch over most of its height and between 0.0070–0.0075 inch in the upper end portion thereof (not shown) which is adapted to be necked by a necking apparatus as disclosed and claimed in either the aforesaid prior application Ser. No. 07/929,932 or U.S. patent application Ser. No. 07/872,484, filed Apr. 23, 1992, which pertains to die necking and is also assigned to Reynolds Metals Company. In accordance with the present invention, container 10 desirably features a relatively thin bottom wall (generally designated with reference numeral 15) having a thickness A of, for example, approximately 0.0070–0.0075 inch, as opposed to conventional thicknesses of 0.012 inch. The thin bottom wall 15 does not depend upon inwardly curved, mechanical features for its bulge resistance, so that the physical properties of the metal in the bottom wall 15 are utilized to satisfy design requirements. That is, it is substantially the tensile strength of the metal (e.g., aluminum has a tensile strength of approximately 40,000 psi) which cooperates with the unique form of the bottom wall 15 to provide the container 10 with the necessary structural integrity.

Figure 4:
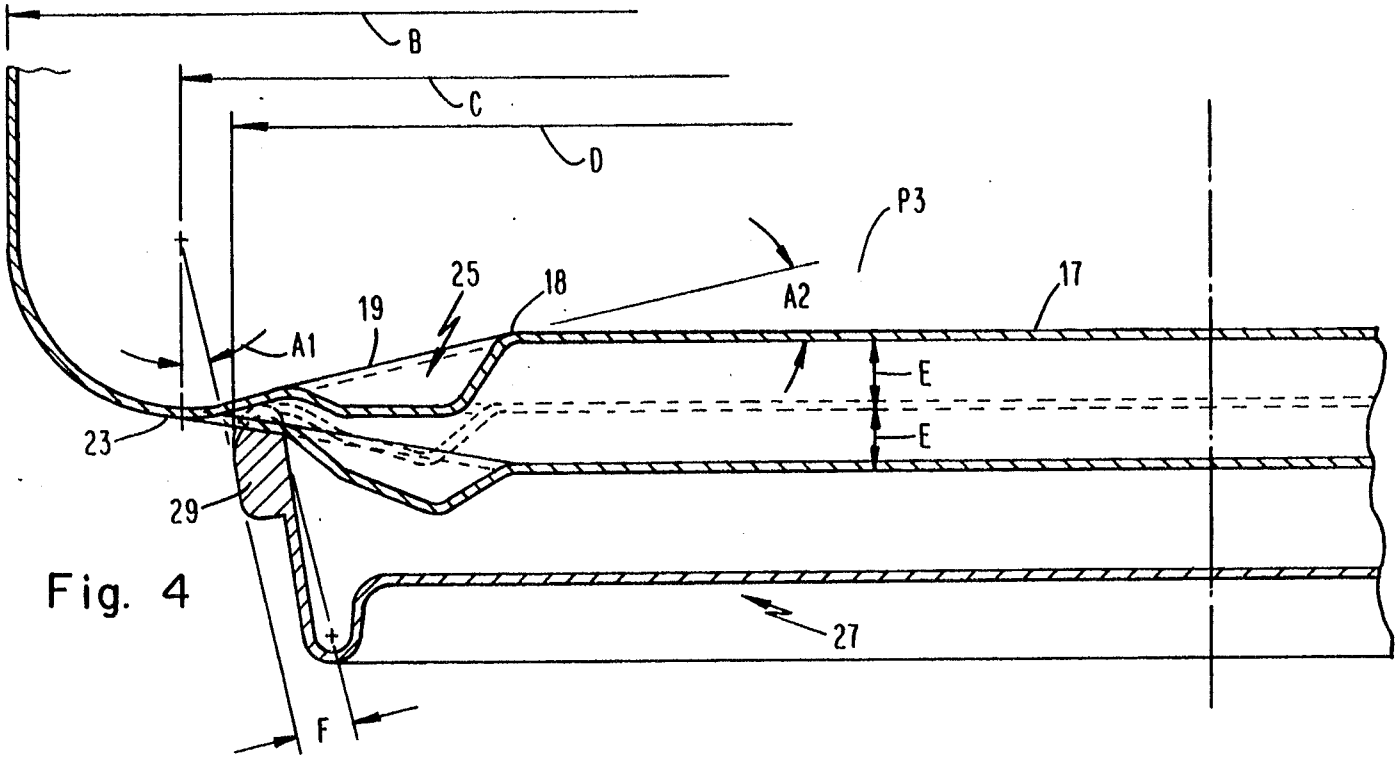
FIG. 4 is another detailed sectional view, similar to FIG. 1, but depicting other features of the present invention.
Figure 5B:
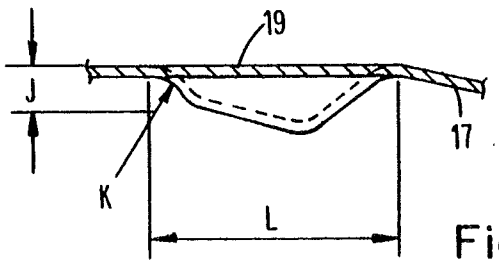
FIG. 5B is a sectional view taken along the line 5B—5B of FIG. 2.
Figure 5A:
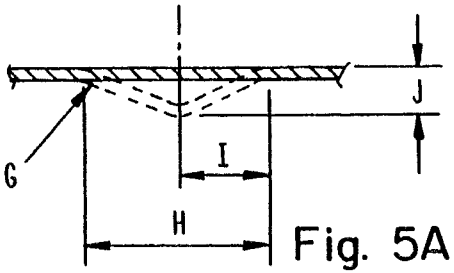
FIG. 5A is an elevational end view of a stacking foot viewed along a radial line inwardly towards the rounded outer apex.

In the presently preferred embodiment, the container bottom wall 15 is provided with a central, substantially circular panel 17 which is movable between a raised position (depicted in solid line) and a lowered position (depicted in phantom line) and which is connected to an annular inclined or frustum wall portion 19 which is in turn connected to an annular curved wall 21 defining the periphery of the bottom wall 15. The annular curved wall 21 has a radius of curvature R1 (e.g., R1=0.190 inch) which defines the base radius of the container 10. As described more fully below, this curved wall 21 defines the bottommost portion of the container 10 before displacement, i.e., when the central panel 17 is in the raised position, and therefore presents a downward facing annular rest surface 23 for supporting the bottom during necking and seaming operations. Before displacement, this rest surface 23 resides in a base plane P1, which is orthogonal to the longitudinal axis L1 of the container 10. This wall 21 curves upwardly and outwardly to join the cylindrical side wall 12 of the container 10 at a point P2 residing in a plane P3 which is parallel to plane P1. As measured from that point P2, the curved wall 21 extends downwardly and radially inwardly through 90° to intersect plane P1. This curved wall 21 then subtends an additional angle A1 (e.g., A1=13°), as shown in FIG. 4 only, as it now curves upwardly (in the upper position of panel 17) and still radially inwardly along radius of curvature R1 to meet with the inclined wall 19 which therefore lies along a plane P3' which is tangent to the curved wall 21. As can be seen in FIG. 4 only, this plane P3 in which the inclined wall portion resides forms an angle A2 (e.g., A2=13°) with the plane of the central panel 17. Thus, the central panel 17 and the inclined wall portion 19 intersect at circular region 18 at an angle of 193° in the upward position and at an angle of 167° in the lower position. These angles contrast with angles of in the range of 35° to 90° in inwardly domed can bottoms of the prior art. In the present invention it is important that interior angles (as viewed from inside the can) be greater than 150°.

In the upper, non-tensioned position of the central panel 17, where the panel remains at least during necking and preferably during filling and double seaming of the can end onto it to seal it, the can 10 rests on the annular rest surface 23 at the periphery of the bottom. This gives it support, stability, and resistance to column loads. Since the annular rest surface 23 defining the base radius of the can 10 is located close to the radially outermost position of the can bottom 15, adjacent the container side wall 12 and therefore in substantially coaxial alignment with the side wall, these strong compressive forces are advantageously distributed over a wide area during necking, filling, seaming, etc., to prevent the container from being crushed or wrinkled and therefore rejected. Stated differently, a maximum column load resulting from necking (e.g., about 300 pounds) can be exerted against the can 10 since these forces are fully supported by the annular rest surface 23.

In accordance with a further feature of this invention, a plurality of feet or stacking beads 25 are located within the frustum or inclined wall portion 19 of the container bottom wall 15 to allow for nesting or stacking of the can 10. As the central bottom panel 17 is displaced to its lower, tensioned position, the inclined or frustum wall portion 19 pivots into its lower position relative to the tangent point P4 at which the curved bottom wall portion 21 in the profile base radius intersects the frustum wall portion 19. The frustum wall portion 19 thus functions as a hinge to enable displacement of the central panel 17 into its lower position. In this lower position, the beads or feet 25 project from the bottom 15 to a point below the bottom surface 31 of the central panel 17 to define the lowermost position of the bottom wall 15. In this position, the beads or feet 25 either support the can 10 on a flat surface or, as depicted in FIGS. 1 or 4, enable the can bottom to nest with the top end (i.e., seamed region 29) of an adjacent can below it. These protruding feet 25 provide stable support for the can 10. Instead of four feet equally spaced at 90° intervals there may be eight feet spaced at 45° intervals. Instead of being triangular, the feet may be circular or elliptical. If elliptical, the long axis of the ellipse should intersect the lontidudinal axis of the can.

Precise structural details and geometry of these stacking feet or beads 25 are depicted in FIGS. 1–5A, 5B which show a twelve ounce aluminum beverage can having an outer diameter B of 2.613 inches. These drawings are to scale. While the stacking beads 25 may have various geometries, from the standpoint of can-making using drawing and ironing equipment in a known manner and as discussed briefly below, each stacking bead 25 is preferably triangular in plan view (FIG. 2) and has a pair of first and second relatively wide triangular sides or faces 35 which meet in a radially outer location of the inclined wall 19 to define a smoothly rounded apex 37 in plan view. The joining base edges 39 of these sides 35 are co-extensive with each other and extend radially inward towards the central panel 17 while remaining in base plane P1 when the central panel is in its upper, non-tensioned position, which is best depicted in FIG. 1. These base edges 39 of the sides 35 terminate at a location or apex 41 spaced radially outwardly from the outermost periphery of the central panel 17 where they intersect the altitude legs 43 of these triangular faces 35 which extend outwardly (circumferentially) away from the edges 39, radially inwardly, and upwardly to intersect the vertices 45 formed with the radially innermost ends of the hypotenuse legs 47. These altitude legs 43 intersect to form the lower vertex 41 of a third substantially triangularly shaped face 49 of each stacking bead 25, which extends radially inwardly and upwardly from the vertex 41 to its hypotenuse leg 51 which extends along and is a part of the outer periphery of the central panel 17 at the region of intersection with the inclined wall 19. In plan view, therefore, this hypotenuse leg 51 is somewhat arcuate in shape and has a radius of curvature equal to the radius of the central panel 17. This hypotenuse leg 51, and altitude legs 43 define the third triangular face 49.

When the central panel 17 is in its upper, non-tensioned position, the bottommost portion of each stacking bead 25 is defined by the base legs 39 of the wide triangular faces 35 which do not project elevationally below the downward facing annular surface 23 in the base radius of the container bottom wall 15. However, these base edges 39 are preferably co-extensive with base plane P1 to give the greatest stacking height when the central panel 17 is displaced downwardly to its lower, tensioned position depicted in FIG. 1.

In the lower, tensioned position, the stacking beads or feet 25 project downwardly from the central panel so that the rest points (vertices 41) define the lowermost surfaces of the bottom 15 to support the can 10 on a flat surface or enable the can bottom to nest with the top end of another can as shown. To enable nesting to occur between non-pressurized cans 10 or stacking to occur after pressurization, the bottom surface of the inclined or frustum wall 19, when seen in cross-sectional elevational view in the region proximate to the radially outermost apex 37 between the wide faces 35 of each stacking foot 25, is formed with a concave recess or depression 60 at a radial location (relative to the longitudinal axis L1 of the can 10) adapted to receive the top edge of a double seamed can end 29 of the adjacent below can as shown. This indentation 60 tends to remain substantially in the same radial location whether the central panel 17 and inclined wall 19 are in their upper or lower 'diaphragm' positions to advantageously enable the aforesaid nesting or stacking to occur.

It is preferred that the displacement of the bottom wall from the upper, non-tensioned position to the lower, tensioned position be effected after filling the can body with a carbonated beverage and seaming a can end onto the top of it, in which case the internal pressure of carbonation causes the displacement. Alternatively, the displacement may be effected prior to or simultaneously with filling by mechanical means (e.g., a plunger or piston), or fluid means (e.g., air pressure). In either case the bottom wall will remain in the lower, tensioned position after the can is opened by the consumer.

The structure of the bottom wall 15 of FIGS. 1–4 uniquely provides a pressure resistant configuration wherein the geometry allows the bottom 15 to utilize the tensile strength of the metal to resist seaming and buckling loads, and especially internal pressurization which has resulted in bulging of known container bottom walls as a result of unrolling or reversal of the rest radius in profiled container bottoms. That is, in the upper, non-tensioned position of the central panel 17, it is the large diameter downward facing annular rest surface 23 in the base radius of the can 10 which provides substantially sole support against column loads during necking and preferably during seaming and filling. Displacement of the panel 17 downwardly into its lower, tensioned position causes the stacking feet 25 to project below the central panel 17 and the base radius support surface 23 to provide stable resting and stacking support for the can. Since the container bottom wall 15 is essentially 'featureless' (i.e., there are no mechanical profiles in the bottom which are likely to 'unroll' as a result of internal pressurization), the tensile strength of the metal bottom wall in combination with the unique geometry is what enables the container bottom to maintain its pressure resistant configuration in the lower tensioned position since there are no features in the bottom which are subject to further pressure displacement after the central panel is normally displaced downward. As a result, the container bottom wall desirably may be formed with a metal thickness of less than 0.012 inch, and preferably about 0.0070–0.0075 inch. Consequently, the present invention is believed to allow for a reduction in the amount of metal in the can bottom, possibly as much as 30%.

By way of example only, and with reference to the drawing figures, the following dimensions may be utilized to form can bottom walls according this invention which are capable of stacking with the upper end of size 202 cans (using can-makers' conventional terminology):

| | | | |
|---|---|---|---|
| A | .0070–.0075 inch | G | .025 inch |
| B | 2.613 inches | H | .200 inch |
| C | 2.234 inches | I | .100 inch |
| D | 2.135 inches | J | .050 inch |
| E | .080 inch | K | .050 inch |
| F | .062 inch | L | .270 inch |

A can bottom wall 15 having the foregoing features in accordance with the present invention advantageously allows the can body 10 to be manufactured by existing drawing and ironing equipment. That is, the can is first drawn to essentially a cylindrical shape as is well known. On impact with base reform tooling, the bottom is reversed upwardly inward approximately 0.080 inch relative to the base radius and the frustum conical or inclined wall 19 is formed in it together with the four stacking projections or feet 25. These features are advantageously added to the can bottom wall during the reform action. This is because if the features were added onto the punch or on the cup when running the punch through the drawing and ironing rings, the can would very likely be torn apart. Therefore, the foregoing features are essentially formed in the bottom wall at the bottom of the stroke after the can has been completely drawn and ironed and they are induced into the metal bottom in the reform upward stroke. Given the foregoing description of the can bottom wall geometry, the features of the invention may be formed with minor modifications to the existing tools as will now occur to one of ordinary skill in the art upon review of this disclosure.

As mentioned above, the stacking beads 25 may have various types of geometries as will now occur to one of ordinary skill in the art. However, the foregoing triangular shaped configurations are desirable since this geometry is conducive to prevention of metal tearing during formation of the stacking features in the reform stroke. For example, since the deepest part of the stacking projections 25 is formed at a radially inward location where the base legs 39 of the wide triangular faces 35 intersect the relatively sharply sloped third triangular face 49, less stress is placed on the metal by locating the vertices 45 of the respective wide triangular faces 35 farther apart from each other to provide a relatively shallow slope for each triangular face. The feet may be touch-coated with a relatively soft insulating material such as vinyl to prevent the can from scratching or sweating on furniture after it has been opened by the consumer.

While presently preferred embodiments of the invention have been illustrated and described, it will be understood that the invention is not limited thereto, but may be otherwise variously embodied within the scope of the following claims.

What is claimed is:

1. A metal container, comprising a bottom wall and a side wall extending substantially axially from the bottom wall to define an open end of the container adapted to be closed with a can end seamed onto said open end, wherein said bottom wall includes a pre-formed central panel, an outer curved wall portion extending downwardly and inwardly from the side wall toward the central panel, and a substantially flat wall portion extending generally continuously between the curved wall portion and the central panel, said central panel being displaceable between an upper position wherein the outer curved wall portion is adapted to support the container at least during necking, and a lower position in which a plurality of feet formed in the bottom wall radially inwardly from the curved wall portion project beyond the curved wall portion so as to present rest surfaces or points for supporting the container on a horizontal surface after pressurization, said feet being spaced from each other and from the longitudinal axis of the can body.

2. The metal container of claim 1, wherein said flat wall portion is an inclined or frustum wall portion which is movable, relative to the curved wall portion, to act as a hinge to enable said central panel to move into one of its upper or lower positions.

3. The metal container of claim 2, wherein, in the upper position, said inclined wall portion projects upward in the radially inward direction and, in the lower position, said inclined wall projects downward in the radially inward direction.

4. The metal container of claim 2, wherein said curved wall is defined by a radius of curvature which is the base radius of the container.

5. The metal container of claim 2, wherein said feet are formed in the inclined wall portion at circumferentially spaced intervals from each other.

6. The metal container of claim 2, wherein, between the feet, only substantially flat wall portions of generally uniform thickness interconnect the curved wall portion to the central panel.

7. The metal container of claim 2, wherein said central panel is substantially flat and of substantially uniform thickness.

8. The metal container of claim 7, wherein said inclined wall portion is of substantially uniform thickness.

9. The metal container of claim 8, wherein said inclined wall portion and central panel are of substantially the same thickness.

10. The metal container of claim 9, wherein said curved wall portion is of the same thickness as said central panel.

11. The metal container of claim 7, wherein said thickness is less than 0.012 inch.

12. The metal container of claim 9, wherein said thickness is approximately 0.007 inch.

13. The metal container of claim 5, wherein the radially outermost bottom surface portion of each foot intersects the bottom surface of the surrounding inclined wall portion so as to define a substantially concave recess, in cross-sectional elevational view, which is radially positioned in relation to the container longitudinal axis, to establish a stacking surface adapted to interfit with an upper seamed edge of an adjacent below container to provide for stacking engagement.

14. The metal container of claim 5, wherein each stacking foot has a pair of first and second relatively wide triangular sides or faces projecting below the plane of said inclined wall portion and a third, smaller, generally triangular face extending between radially inwardly located edges of said first and second triangular sides to form an inverted pyramid, wherein the apex of said first, second and third faces defines a resting or supporting point for the container when the central panel is in its lower, tensioned position.

15. A metal can body formed from a single piece of metal sheet and comprising:

a generally cylindrical side wall having a maximum thickness less than 0.005 inch, except for a relatively thick portion at its upper end which has a maximum thickness less than 0.008 inch;

a bottom wall having an outer annular, curved portion whose profile is a curve defined by the base radius, the curved wall portion being joined to the side wall, the bottom wall having a thickness less than 0.12 inch and a plurality of downwardly projecting feet spaced from each other and from the longitudinal axis of the can body;

the central region of the bottom all being displaceable in diaphragm-like fashion between two positions—a first, upper position in which neither the feet nor any of the bottom radially inward of its curved wall portion are disposed below the lowermost extremity of the curved wall portion, and a second, lower position in which all of the feet and all of the bottom radially inward of its curved wall portion are disposed below the lowermost extremity of the curved wall portion;

whereby the curved wall portion of the bottom wall is capable of supporting the can body when the cylindrical walls are under compressive column loads incident to necking of their relatively thick upper portion, and whereby, after the can body has been filled with product, closed and sealed by the seaming of a can end thereon, and subjected to internal pressure, the thinness of the bottom wall allows its central region to deform downwardly as dictated by the internal pressure, so that all of the bottom except the feet is in tension, yet the lowermost extremities of the feet constitute a resting surface for stably supporting the can on a horizontal surface.

16. A metal can body according to claim 15 wherein the maximum thickness of the bottom wall is less than 0.008 inches.

* * * * *